US010247404B1

(12) United States Patent
Hillyard

(10) Patent No.: US 10,247,404 B1
(45) Date of Patent: Apr. 2, 2019

(54) PIN LIGHT ASSEMBLY

(71) Applicant: Waterway Plastics, Oxnard, CA (US)

(72) Inventor: Jason Hillyard, Fillmore, CA (US)

(73) Assignee: Waterway Plastics, Oxnard, CA (US)

( * ) Notice: Subject to any disclaimer, the term of this patent is extended or adjusted under 35 U.S.C. 154(b) by 0 days.

(21) Appl. No.: 15/697,258

(22) Filed: Sep. 6, 2017

(51) Int. Cl.

| | |
|---|---|
| ***F21V 31/00*** | (2006.01) |
| ***F21V 7/00*** | (2006.01) |
| ***F21K 9/20*** | (2016.01) |
| ***F21V 7/09*** | (2006.01) |
| *F21W 131/401* | (2006.01) |
| *F21Y 115/10* | (2016.01) |

(52) U.S. Cl.
CPC ..... *F21V 31/005* (2013.01); *F21K 9/20* (2016.08); *F21V 7/0083* (2013.01); *F21V 7/09* (2013.01); *F21W 2131/401* (2013.01); *F21Y 2115/10* (2016.08)

(58) Field of Classification Search
None
See application file for complete search history.

(56) References Cited

U.S. PATENT DOCUMENTS

| | | | | |
|---|---|---|---|---|
| 7,604,364 | B2 | 10/2009 | Walker et al. | |
| 8,079,726 | B1 * | 12/2011 | Hui | F21S 8/00 362/101 |
| 9,976,706 | B2 * | 5/2018 | Schwalenberg | F21V 23/0457 |
| 10,145,523 | B2 | 12/2018 | Hillyard et al. | |
| 2007/0285915 | A1 | 12/2007 | Rosenau et al. | |
| 2012/0275163 | A1 * | 11/2012 | Chen | F21V 23/009 362/294 |

* cited by examiner

*Primary Examiner* — Sharon E Payne
(74) *Attorney, Agent, or Firm* — Sandy Lipkin

(57) ABSTRACT

A pin light assembly with specialized elastomeric grommet and cylindrical pin attached to the light lens for installation into the substrate of a spa wall that overcomes minimum outer diameter light limitations found in the prior art elastomeric grommet installation systems wherein the elastomeric grommet portion of the pin light assembly receives the LED light thereby eliminating the need for a tube to receive the LED and have a separate elastomeric grommet installed outside of the light lens tube. Optional features include retaining features such as a barb around the cylindrical pin or a retaining flange with undercut at the termination of the cylindrical pin.

10 Claims, 4 Drawing Sheets

PIN LIGHT ASSEMBLY

BACKGROUND OF THE INVENTION

Field of the Invention

The field of this invention relates generally to the field of pin light assemblies for use in portable spas, and more particularly toward an improved single LED light employing an elastomeric grommet seal.

Description of the Prior Art

Portable spas are popular means for providing relaxation and recovery from exertion to the body. Portable spas are often employed after dark in which case lights are employed inside of the spa to illuminate the spa for the occupants. In a typical scenario, pin lights, i.e., single LED light assemblies are often employed for this purpose. In a typical assembly, there is a relatively small light lens that is illuminated by the single LED light source. A transparent or translucent light lens creates a finished appearance for such LED lighting.

The front face of the light lens can be of varying design and can have any number of patterns. The light lens doubles as a flange and has a cylindrical tube extruded from the back side of the lens with an inner diameter large enough to accommodate a single LED light within the tube in which the pin light is housed. The outer diameter of the cylindrical tube could be smooth to accept an elastomeric grommet or it could be threaded for use with a nut. The benefit for using an elastomeric grommet for installation, rather than a nut, is that the elastomeric grommet can be installed more quickly, which reduces labor costs and speeds up production.

The elastomeric grommet seal is formed by radial compression within a hole in the spa substrate caused by a tube diameter of the light lens being larger than the inner diameter of the elastomeric grommet, which forces the elastomeric grommet to compress tightly against the inner diameter of the hole. A significant negative point when the elastomeric grommet is employed in the standard single LED pin light assembly is that the elastomeric grommet outer diameter requires a larger flange and outer diameter of the light lens than is required by the nut style assembly. The larger flange is required because of the fixed size of the LED coupled with the minimum thickness of the light lens tube surrounding the LED. Further, the thickness of the elastomeric grommet surrounding the light lens tube needs to be large enough for the flange to overlap hole in the substrate, i.e., the spa wall because the hole must accommodate the elastomeric grommet, light lens tube and LED with the hole inner diameter. This limits the viability of employing an elastomeric grommet seal, because of the desired effect of having a small pin point of light.

It is the object of the instant invention to provide an improved assembly that overcomes other shortcomings of the prior art.

It is a further object of the instant invention to provide a smaller surface area of the pin of the light lens which is easier to install into the elastomeric grommet than the standard light lens with a cylindrical tube that is larger than the LED that is installed within the tube. In the instant invention, the surface area of the pin is greatly reduced when compared to the surface are of the cylinder. Another object of the invention is to provide the option for a small perimeter or small diameter light lens as possible in an improved elastomeric grommet installation system.

SUMMARY OF THE INVENTION

The basic embodiment of the present invention teaches a pin light assembly for installation into a substrate having an aesthetic side and a wiring side comprising: a cylindrical elastomeric grommet with an outer diameter nearly the same as the diameter of a hole in said substrate said elastomeric grommet further comprising: a front end with an elastomeric grommet flange, said elastomeric grommet flange having a diameter slightly larger than said hole; a second end having a chamfer for easy installation into said hole; a first longitudinal opening proximate said flange; a second longitudinal opening proximate said chamfer; wherein said cylindrical elastomeric grommet is pre-installed in said hole; an LED light for placement inside of said second longitudinal opening; a cylindrical pin, said cylindrical pin further comprising: a top portion; a bottom portion; said top portion having a pin flange with a diameter larger than said elastomeric grommet flange wherein said pin flange rests atop said elastomeric grommet flange when installed wherein said pin flange also functions as a light lens from said top portion when said LED light is installed and actuated wherein the light lens may have various esthetic perimeter shapes outside the diameter of the pin flange; and said bottom portion terminating in a securing member that affixes said pin inside of said first longitudinal opening in said elastomeric grommet wherein compression from said pin against said elastomeric grommet within said hole retains said elastomeric grommet and said lens in said substrate.

The above embodiment can be further modified by defining that a retaining barb is affixed to said bottom portion of said cylindrical pin wherein said retaining barb extends outward from said bottom portion along the circumference of said bottom portion.

The above embodiment can be further modified by defining that a terminating flange with undercut is affixed to said bottom portion of said cylindrical pin.

The above embodiment can be further modified by defining that said LED light is secured in said second longitudinal opening via compression of said elastomeric grommet against said LED through said longitudinal opening that is configured to have a slightly smaller diameter than said LED light.

The above embodiment can be further modified by defining that said LED light is secured in said second longitudinal opening with a nut.

The above embodiment can be further modified by defining that a mass of material is separating said first and second longitudinal openings wherein the elastomeric grommet material should be transparent or translucent to transmit the light from the LED, through the mass in the elastomeric grommet, to the light lens for viewing the light from the esthetic side of the substrate.

The above embodiment can be further modified by defining that there is an interconnected opening between said first longitudinal opening and said second longitudinal opening wherein the elastomeric grommet material may be opaque to transmit the light from the LED, through the interconnected opening in the elastomeric grommet to the light lens for viewing the light from the esthetic side of the substrate. The elastomeric grommet material may alternately be transparent or translucent to transmit the light from the LED, through the interconnected opening in the elastomeric grommet as well as through the grommet material, to the light lens for viewing the light from the esthetic side of the substrate.

An alternate embodiment of the instant invention provides for a pin light assembly for installation into a substrate having an aesthetic side and a wiring side comprising: a cylindrical elastomeric grommet with an outer diameter nearly the same as the diameter of a hole in said substrate said elastomeric grommet further comprising: a front end with an elastomeric grommet flange, said elastomeric grommet flange having a diameter slightly larger than said hole; a second end having a chamfer for easy installation into said hole; a longitudinal opening in the interior of said elastomeric grommet; wherein said cylindrical elastomeric grommet is pre-installed in said hole; an LED light for placement inside of said longitudinal opening wherein compression from said pin against said elastomeric grommet within said hole retains said elastomeric grommet and said lens in said substrate.

The above embodiment can be further modified by defining that said elastomeric grommet flange is positioned on said aesthetic side of said substrate.

The above embodiment can be further modified by defining that said elastomeric grommet flange is positioned on said wiring side of said substrate.

The invention illustratively disclosed herein suitably may be practiced in the absence of any element which is not specifically disclosed herein.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
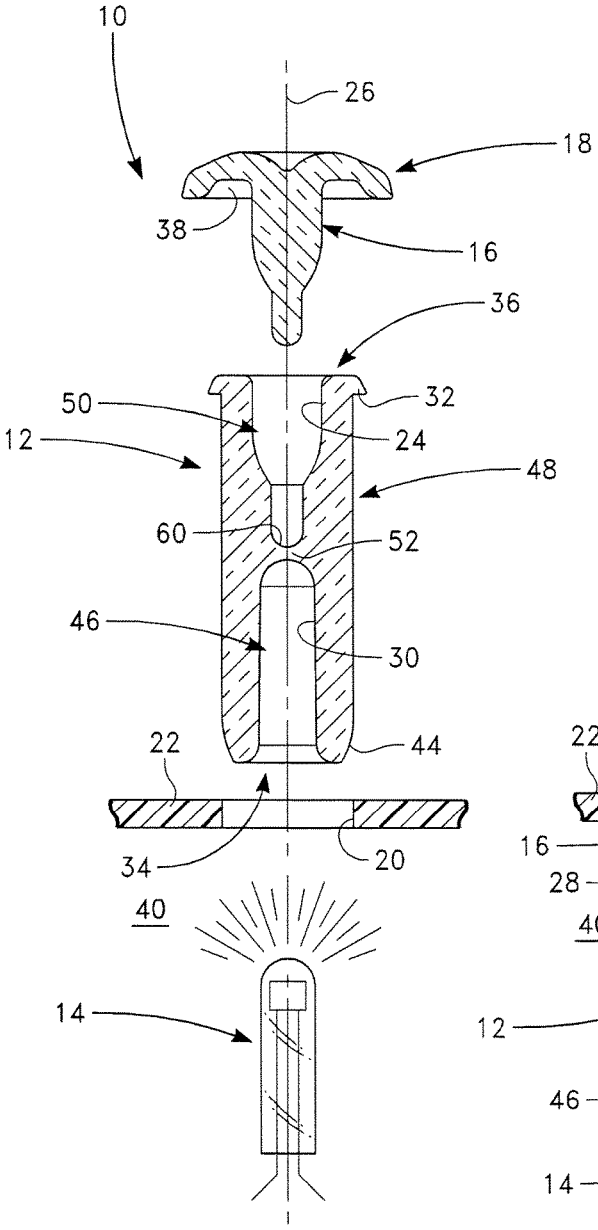
FIG. 1 is an exploded cross-sectional side view of the pin light assembly of the instant invention.
Figure 2:
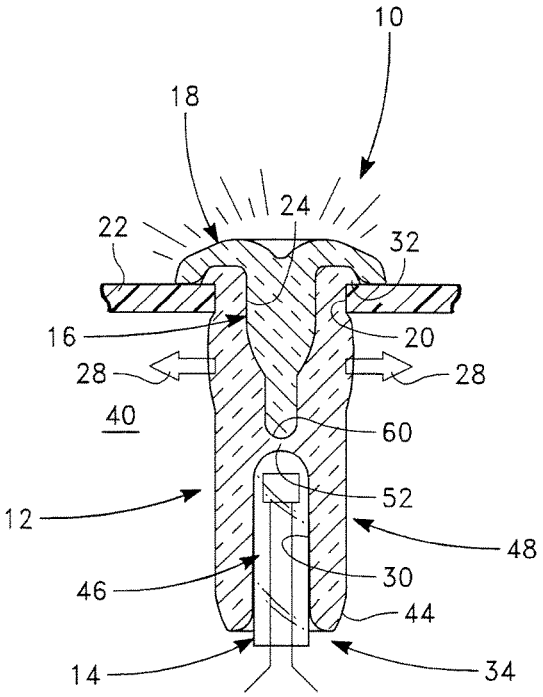
FIG. 2 is a cross-sectional side view of the pin light assembly of the instant invention as it is affixed to a spa wall.

Turning to the drawings, the preferred embodiment is illustrated and described by reference characters that denote similar elements throughout the several views of the instant invention.

The instant invention discloses and improved pin light assembly 10 that overcomes the minimum outer diameter light lens limitation of the elastomeric grommet version of the prior art by using the elastomeric grommet 12 of the instant invention as the receiving component for an LED light 14. This eliminates the need for the light lens to have a tube to receive the LED and have an elastomeric grommet installed outside of the light lens tube.

In order to compress the elastomeric grommet 12 to create the radial seal, a cylindrical pin 16 is employed on the back side 38 of the light lens 18 in place of the tube commonly used. When the light lens 18 is pressed into the elastomeric grommet 12 with the elastomeric grommet 12 having been preinstalled into a hole 20 in the spa wall 22, the pin 16 forces the elastomeric grommet 12 inner diameter 24 away from the common axis 26 and creates the predetermined compression 28 of the elastomeric grommet 12 within the spa wall 22 hole 20.

Once the elastomeric grommet 12 is secured in place with the light lens 18, the LED 14 can be installed into the back 34 of the elastomeric grommet 12 in the second inner opening/tube 46. The LED 14 can be secured in place with a boot or a nut, which is customary, or the LED 14 can be held in place using an undersized inner diameter hole 30 in the second inner opening/tube 46 of the elastomeric grommet 12. The undersized elastomeric grommet tube 46 creates enough resistance to hold the LED 14 in place.

The pin point lighting system 10 of the instant invention employs an elastomeric grommet 12 that seals the light lens 18 within a hole 20 in the spa substrate 22. The light lens 18 has a cylindrical pin 16 extruded from the back side 38 of the light lens 18 along a common longitudinal axis 26 with the elastomeric grommet 12 and LED light source 14. The pin 16 fits within the inner diameter 24 of the elastomeric grommet 12 and provides compression 28 against the elastomeric grommet 12 to create a water tight seal against the inner diameter bore of hole 20 in the spa wall 22.

The elastomeric grommet 12 has a flange 32 on the front side 36 that is larger in diameter than the spa substrate 22 hole 20 diameter. The flange 32 rests against the water side of the spa substrate 22 and prevents the elastomeric grommet 12 from pressing through the hole 20 during installation of the light lens 18. The elastomeric grommet 12 has a cylinder close to the diameter of the receiving hole 20 in the spa wall 22, starting from the front side 36 grommet 12 flange 32 at the water side of the spa wall 22 and extending through the substrate 22 hole 20 and terminating beyond the opposing, non-water side 40 of the spa wall 22 having enough length to accommodate the LED light source 14 and light lens 18.

The outer diameter of the back side 34 of the elastomeric grommet 12 has a chamfer 44 which helps with aligning the elastomeric grommet 12 within the hole 20 for ease of installation. The elastomeric grommet 12 has a second inner opening/ tube 46 around the common longitudinal axis 26 that extends from the back side 34 of the elastomeric grommet 12 to a central region 48 of the elastomeric grommet 12. The back side tube 46 receives the LED light source 14. A first inner opening/tube 50 extends from the front side 36 of the elastomeric grommet 12 around the common longitudinal axis 26 and terminates in the central region 48 of the elastomeric grommet 12, leaving a solid portion 52 of material that separates the second inner opening/tube 46 from the first inner opening/tube 50, which prevents water from leaking through the interior of the elastomeric grommet 12.

Figure 3:
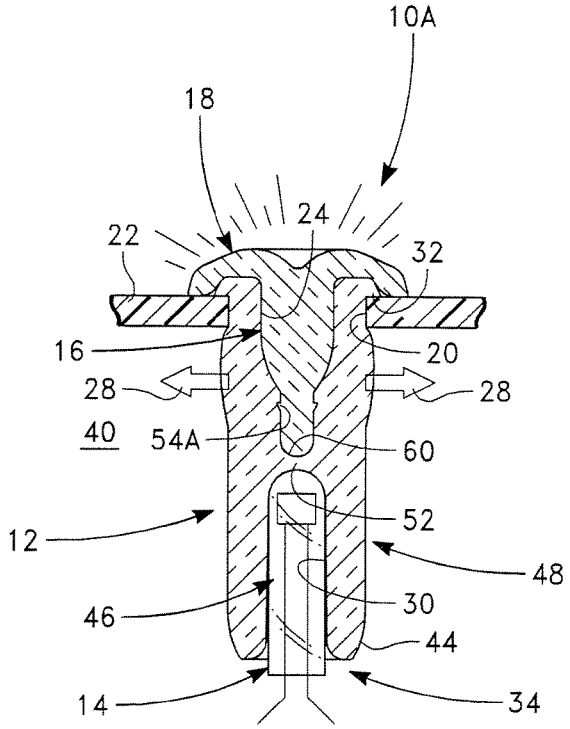
FIG. 3 is a first alternate embodiment of the pin light assembly of the instant invention with a retaining barb in the affixed position to a spa wall.
Figure 4:
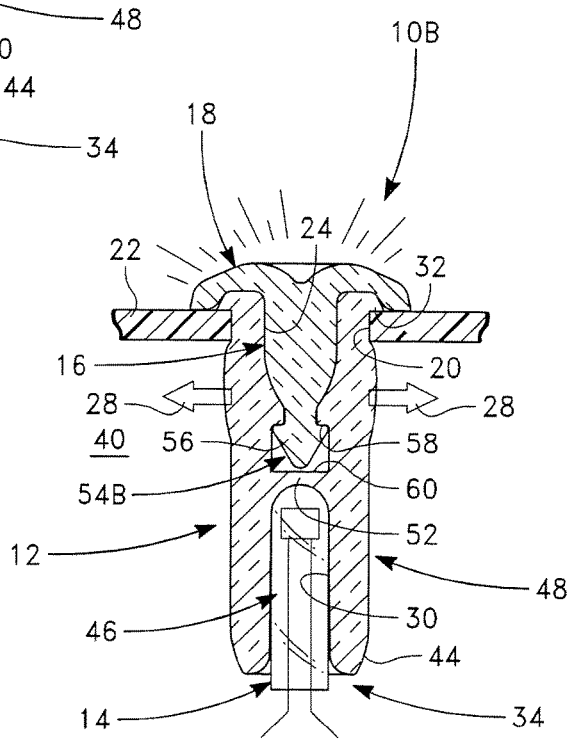
FIG. 4 is a second alternate embodiment of the pin light assembly of the instant invention with a retaining flange and undercut in the affixed position to a spa wall.

The first side tube 50 on the front end of the elastomeric grommet 12 receives the pin 16 of the light lens 18. The design can be augmented with optional retaining features 54A, 54B as seen in first alternate embodiment 10A in FIG. 3 and second alternate embodiment 10B in FIG. 4. These retaining features 54A, 54B are added to the light lens 18 cylindrical pin 16 to help retain the pin 16 inside of the elastomeric grommet 12. In the first alternate embodiment 10A, a barb 54A is added to the pin 16 circumferentially to help hold it in place inside of the first opening tube 50 inside of the elastomeric grommet 12. The second alternate embodiment 10B in FIG. 4 utilizes a flange 54B at the end of the pin 16 with an undercut 58 that holds the flange 54B inside of the first opening tube 50 toward the terminating end 60 of the first front side opening/tube 50.

Figure 8:
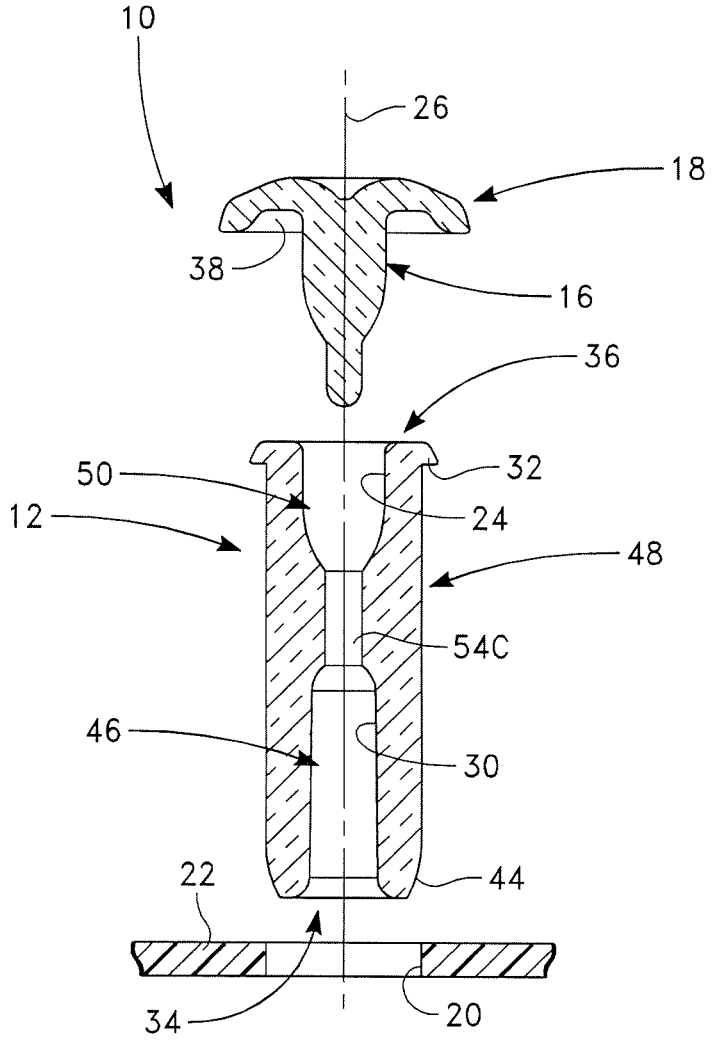
FIG. 8 shows an alternate version wherein there is no mass of material between the longitudinal channels of the pin light assembly of the instant invention.

FIG. 8 shows an alternate embodiment wherein there is no mass of material 54C between the two longitudinal openings 46, 50. In this embodiment, there is an interconnected opening between said first longitudinal opening and said second longitudinal opening wherein the elastomeric grommet material may be opaque to transmit the light from the LED, through the interconnected opening in the elastomeric grommet to the light lens for viewing the light from the esthetic side of the substrate. The elastomeric grommet material may alternately be transparent or translucent to transmit the light from the LED, through the interconnected opening in the elastomeric grommet as well as through the grommet material, to the light lens for viewing the light from the esthetic side of the substrate.

Figure 5:
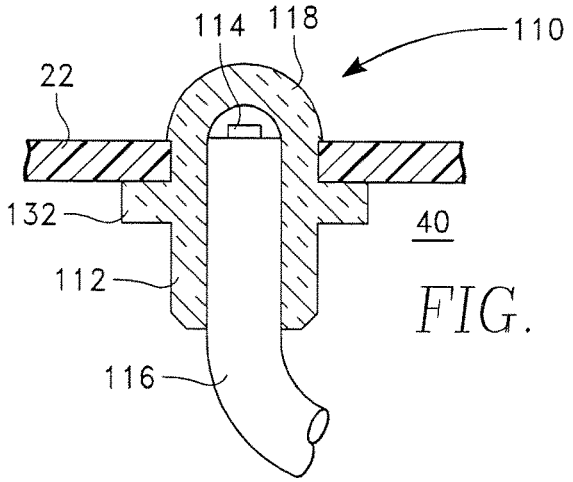
FIG. 5 is a first alternate embodiment of the assembly of the instant invention wherein the LED light is the pin with a flange positioned on the non-water side of the spa wall.
Figure 6:
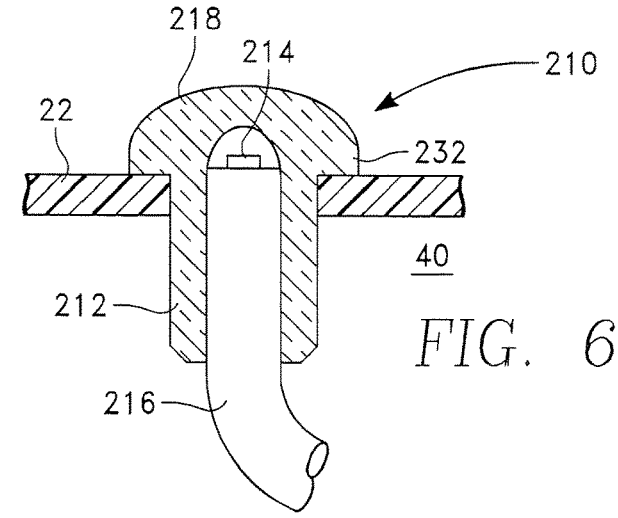
FIG. 6 is a second alternate embodiment of the assembly of the instant invention wherein the LED light is the pin with a flange positioned on the water side of the spa wall.
Figure 7:
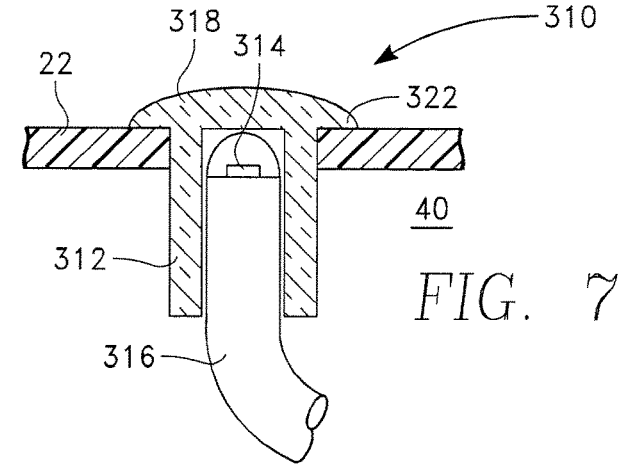
FIG. 7 is an alternate version of the embodiment shown in FIG. 6 with a shorter profile at the end.

It is to be understood that the instant invention is not applicable solely for walls inside of spas or pools or even where water tightness is necessarily required. The instant invention provides a means of installation of an elastomeric grommet with LED light for aesthetic purposes wherein there is one side where the LED is visible, dubbed the aesthetic side and one side where the wiring is found, dubbed the wiring side. Only radial compression of the elastomeric grommet within the hole into which it is to be fitted fixes the assembly of the LED light to the substrate. As such, the cylindrical pin light component can be omitted entirely and the LED placed directly inside the elastomeric grommet as illustrated in FIGS. 5-7.

In these alternate embodiments the cylindrical pin light is omitted entirely and the LED is used to create the compression within the hole. This omits the first longitudinal opening found in the first embodiment and extends the second longitudinal opening up toward the elastomeric grommet flange. The flange side of the elastomeric grommet acts as a lens for the LED. In FIG. 5 the assembly 110 includes an elastomeric grommet 112 with a flange 132 which sits on the wiring side 40 of the substrate 22. The LED 114 is itself the pin 116 with the lens 118 being found on the aesthetic side of the elastomeric grommet 112. In FIGS. 6 and 7, two different versions of the same embodiment 210, 310 are shown, the difference between the two being the profile height of the lens portion 218, 318 of the elastomeric grommet 212, 312. In this version, the LED 214, 314 acts as the pin 216, 316 like in FIG. 5, but the elastomeric grommet 212, 312 has a flange 232, 332 on the aesthetic side of the substrate 22.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A pin light assembly for installation into a substrate having an aesthetic side and a wiring side comprising:

a cylindrical elastomeric grommet with an outer diameter nearly the same as the diameter of a hole in said substrate said elastomeric grommet further comprising:

a front end with an elastomeric grommet flange, said elastomeric grommet flange having a diameter slightly larger than said hole;

a second end having a chamfer for easy installation into said hole;

a first longitudinal opening proximate said flange;

a second longitudinal opening proximate said chamfer;

wherein said cylindrical elastomeric grommet is pre-installed in said hole;

an LED light for placement inside of said second longitudinal opening;

a cylindrical pin, said cylindrical pin further comprising:

a top portion;

a bottom portion;

said top portion having a pin flange with a diameter larger than said elastomeric grommet flange wherein said pin flange rests atop said elastomeric grommet flange when installed wherein said pin flange also functions as a light lens from said top portion when said LED light is installed and actuated wherein the light lens may have various esthetic perimeter shapes outside the diameter of the pin flange; and said bottom portion terminating in a securing member that affixes said pin inside of said first longitudinal opening in said elastomeric grommet wherein compression from said pin against said elastomeric grommet within said hole retains said elastomeric grommet and said lens in said substrate.

2. The pin light assembly as defined in claim 1 wherein a retaining barb is affixed to said bottom portion of said cylindrical pin wherein said retaining barb extends outward from said bottom portion along the circumference of said bottom portion.

3. The pin light assembly as defined in claim 1 wherein a terminating flange with undercut is affixed to said bottom portion of said cylindrical pin.

4. The pin light assembly as defined in claim 1 wherein said LED light is secured in said second longitudinal opening via compression of said elastomeric grommet against said LED through said longitudinal opening that is configured to have a slightly smaller diameter than said LED light.

5. The pin light assembly as defined in claim 1 wherein said LED light is secured in said second longitudinal opening with a nut.

6. The pin light assembly as defined in claim 1 wherein a mass of material is separating said first and second longitudinal openings wherein the elastomeric grommet material should be transparent or translucent to transmit the light from the LED, through the mass in the elastomeric grommet, to the light lens for viewing the light from the esthetic side of the substrate.

7. The pin light assembly as defined in claim 1 wherein there is an interconnected opening between said first longitudinal opening and said second longitudinal opening wherein the elastomeric grommet material may be opaque to transmit the light from the LED, through the interconnected opening in the elastomeric grommet to the light lens for viewing the light from the esthetic side of the substrate. The elastomeric grommet material may alternately be transparent or translucent to transmit the light from the LED, through the interconnected opening in the elastomeric grommet as well as through the grommet material, to the light lens for viewing the light from the esthetic side of the substrate.

8. A pin light assembly for installation into a substrate having an aesthetic side and a wiring side comprising:

a cylindrical elastomeric grommet with an outer diameter nearly the same as the diameter of a hole in said substrate said elastomeric grommet further comprising:

a front end with an elastomeric grommet flange, said elastomeric grommet flange having a diameter slightly larger than said hole;

a second end having a chamfer for easy installation into said hole;

a longitudinal opening in the interior of said elastomeric grommet; wherein said cylindrical elastomeric grommet is pre-installed in said hole;

an LED light for placement inside of said longitudinal opening wherein compression from said LED light against said elastomeric grommet within said hole retains said elastomeric grommet and a lens in said substrate.

9. The pin light assembly as defined in claim 8 wherein said elastomeric grommet flange is positioned on said aesthetic side of said substrate.

10. The pin light assembly as defined in claim 8 wherein said elastomeric grommet flange is positioned on a wiring side of said substrate.

* * * * *